US006061985A

United States Patent [19]

Kraus et al.

[11] Patent Number: 6,061,985

[45] Date of Patent: May 16, 2000

[54] PLATE-SHAPED FIRE-RESISTANT ELEMENT IN A SANDWICH CONSTRUCTION

[75] Inventors: Gerhard Kraus, Lahnau; Bernd Fiedler; Robert Wachter, both of Wetzlar, all of Germany

[73] Assignee: Wilhelmi Werke AG, Lahnau, Germany

[21] Appl. No.: 09/252,305

[22] Filed: Feb. 18, 1999

[30] Foreign Application Priority Data

Mar. 2, 1998 [EP] European Pat. Off. ..... 98103564

[51] Int. Cl.[7] ..... E04B 1/94; E04C 2/18

[52] U.S. Cl. ..... 52/232; 52/586.1; 52/784.11; 52/784.12; 52/787.11; 52/794.1; 52/797.14; 52/800.11; 52/800.12; 52/800.18

[58] Field of Search ..... 52/232, 586.1, 52/784.11, 784.12, 787.11, 794.1, 797.1, 800.11, 800.12, 800.18

[56] References Cited

U.S. PATENT DOCUMENTS 4,125,984 11/1978 Jonas ..... 52/797.1 X
4,624,094 11/1986 Schwindt ..... 52/800.11 X
5,007,222 4/1991 Raymond ..... 52/220.1 X
5,148,645 9/1992 Lehnert et al. ..... 52/443
5,244,709 9/1993 Vanderstukken ..... 52/232 X
5,647,180 7/1997 Billings et al. ..... 52/268

*Primary Examiner*—Christopher T. Kent
*Attorney, Agent, or Firm*—Flynn, Thiel, Boutell & Tanis, P.C.

[57] ABSTRACT

Plate-shaped fire-resistant elements in a sandwich construction have at least three layers connected with one another and resist fire from a front and a back side. The fire-resistant elements are intended in particular for a ceiling or a wall of a building. The elements have a light weight, a high mechanical stability, and can be easily and inexpensively manufactured and installed in a building. The fire-resistant elements have two outer layers and a center layer lying therebetween in the form of a plate, whereby the edge area of the two outer layers is enclosed on at least two oppositely lying sides. Each side has an edge section and the layers are connected with one another. The outer layers have expandable glass granulate or perlite, and the center layer is constructed to prevent passage or penetration of gases.

17 Claims, 3 Drawing Sheets

PLATE-SHAPED FIRE-RESISTANT ELEMENT IN A SANDWICH CONSTRUCTION

FIELD OF THE INVENTION

The invention relates to a plate-shaped fire-resistant element having a sandwich construction with at least three layers that are connected with one another and resist fire from a front and a back side, in particular for a ceiling or a wall in a building.

BACKGROUND OF THE INVENTION

Such a fire-resistant element is known from DE 40 36 735 C2. Two plates made of a material, which is difficult to burn or does not burn, are arranged parallel to one another and at a distance from one another, whereby a U-shaped traverse is mounted between the plates. The legs of the U-shaped traverse rest on the plates, and a web determines the height of the space between the plates Because of this type of design, the known fire-resistant element has a high volumetric weight and therefore requires a particularly complicated, expensive and strong support construction for installation on a ceiling of a room. Moreover, the building height of the fire-resistant element is great, which requires large suspension heights when being installed into a building, and the fire-resistant element is not sound-absorbing.

Furthermore, known is a plate-shaped fire-resistant element, which as a whole is enclosed by a U-section, which extends over the entire height of the plate element and all around same. An adaptation of the plate element to structural conditions, for example, through shortening is thereby not possible.

The basic purpose of the present invention is to produce a plate-shaped fire-resistant element of the above-identified type, which has a low weight, a high mechanical stability and can be easily and inexpensively manufactured and installed into a building.

SUMMARY OF THE INVENTION

This purpose is attained by two outer layers and a center layer lying therebetween constructed as a plate. The edge area of the two outer layers is enclosed at least on two oppositely lying sides each with an edge section. The layers are connected with one another, whereby the outer layers comprise expandable glass granulate or perlite, and the center layer is constructed to prevent passage or penetration of gases. The fire-resistant element has, in contrast to the known devices, because of its sandwich construction in connection with the edge sections, which enclose edge areas of the outer layers, a particularly high mechanical stability but vet a light volumetric weight. The height of the fire-resistant element is particularly low and demands only a little installation space.

A passage of conflagration gases through the fire-resistant element is prevented mainly with the help of the center layer, such that the two outer layers, advantageously reducing the weight of the fire-resistant element, can be porous.

Each volume body of the expandable glass granulate or of the perlite of the outer layers, has a high amount of pores, which in addition lends the fire-resistant element a good insulating action. In the case of a fire, the outer plate-shaped layers sinter on the surface and thus protect the layers arranged inside of the fire-resistant element. Furthermore, due to the outer plates containing expandable glass granulate or perlite, a high degree of sound-absorption is guaranteed. This is particularly advantageous when the fire-resistant element is, for example, installed in hallways and escape routes of buildings. An echoing in these halls is thus avoided.

Since the outer layers are each separately provided with an edge section, these sections are, in addition, thermally separated from one another by the center layer lying therebetween. A transfer of the heat of a fire to the side of the fire-resistant element not facing the fire does not occur. The fire-resistant element can moreover, during installation in a building, be adapted on site through a saw blank cutting the element in a simple manner, as needed, to fit the spacial conditions of a room. Thus an expensive construction of edge sections for various size elements can be eliminated.

According to an advantageous further development of the invention, the longitudinal sides of the outer layers are enclosed with an edge section. The fire-resistant element receives in this manner a particularly high stiffness such that the edge sections are mounted over a great length on the outer layers.

The weight of the fire-resistant element is particularly low when, preferably, at least two of the layers are connected by an adhesive. It is thereby sufficient when the adhesive is only partially, for example in a lattice screen pattern, mounted between the layers. The adhesive should be difficult to enflame. The fire-protection action is particularly improved when the adhesive is nonburnable.

It is particularly advantageous that at least two of the layers are connected by screws or rivets. Thus not only a frictional, but also a positive connection between the layers is created. By clamping or bracing the layers together, a particularly high strength is achieved.

The fire-resistant element is particularly tight with respect to penetration of gases when, according to another advantageous further development of the invention, the center layer is a plaster fiber plate or a calcium silicate plate. Plaster fiber plates and calcium silicate plates are moreover particularly inexpensive to manufacture.

One could imagine that the plate-shaped layers have the same outside dimensions and two or more fire-resistant elements are to be installed adjoining one another in a building. In order to also achieve a fire-protecting action in the spaces between the fire-resistant elements, the outer edges of the fire-resistant elements would then have to be provided, for example, with a fire-resistant mass. The mass, under the action of heat, namely in the case of a fire, swells or foams up and thus closes off the area between the two fire-resistant elements. However, applying the fire-resistant mass to the outside edges of the fire-resistant element is very expensive. It is therefore of a particular advantage, when the middle layer has lesser outside dimensions than the outer layers and when on at least one of the outer edges of the fire-resistant element the center layer is set back with respect to the outer layers, forming a recess. A material, which would swell up in case of a fire, could, for example, be inserted into this recess. The material can thereby be easily inserted into the recess since a flowing out or away is prevented by the groove-shaped design of the recess.

A element preferably can be inserted into the recess, significantly simplifying the manufacture of the fire-resistant element and its installation. The element could consist of any type of a fire-resistant material. However, it is of a particular advantage to create a homogeneous layer structure and thus a uniform protection of the fire-resistant element, when the element is a plaster fiber element or a calcium silicate element. Using a plaster fiber element or a calcium silicate element as the element is furthermore particularly inexpensive.

According to another advantageous further development of the invention, at least one of the edge sections is L or U-shaped in cross section. Thus the section is particularly stiff with respect to a transverse or cross stress and guarantees, moreover, good protection of the edge of the respective plate-shaped layer enclosed by the section. Installation of the section is made easier when the legs of the edge section each have a different length. If preferable, the longer leg of the edge section is arranged on an area of one of the outer layers, which area faces the center layer. Then the center layer is additionally stabilized. A particularly effective edge protection of the outer plates exists when, according to another advantageous further development of the invention, the shorter leg of the L-shaped edge section or a web of the U-shaped edge section, which web connects the legs, covers at least a portion of the edge area of one of the outer layers.

It is of a particular advantage when the screws or the rivets extend at least through one of the legs of the edge sections, which leg faces the center layer. In this manner, not only are the plate-shaped layers securely connected with one another, but the stability of the entire fire-resistant element is significantly increased by including the edge sections into the screwing or riveting.

A projecting of connecting structural parts from the fire-resistant element is advantageously effectively avoided when at least one of the outer layers has, in the area of the screws or rivets, a recess for receiving a screw or rivet head.

It is particularly advantageous when the recess is closed off with a fire-resistant mass. Both the screw or the rivet head, and also the layers of the fire-resistant element, which layers lie on the inside, are protected against a direct flame action.

The fire-resistant element has, according to another advantageous further development of the invention, pins on two oppositely lying sides, whereby the pins form a common swivel axis. It is possible, in this manner, to mount the fire-resistant element pivotally in suitable bearing points of a wall or ceiling construction so that, if necessary, it can be tilted away about the swivel axis and thus a space behind the wall or the ceiling is accessible, for example, for servicing of supply pipelines in a building.

Mounting of the pins on the fire-resistant element can be done particularly easily and inexpensively when the pins are arranged in an area of a leg of one of the edge sections. Each area is constructed as a receiving means. A mounting of additional fastening or bearing elements for the pins is, in this case, advantageously not necessary.

BRIEF DESCRIPTION OF THE DRAWINGS

The invention permits many embodiments. Four of these will be described hereinafter in connection with the attached drawings, in which.

DETAILED DESCRIPTION

Figure 1:
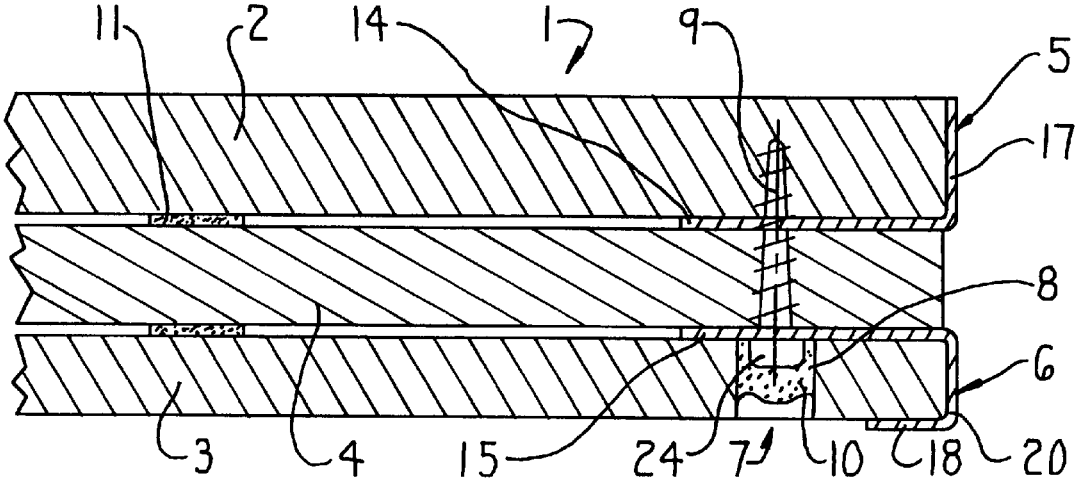
FIG. 1 is a cross-sectional view of a partial area of a fire-resistant element.

FIG. 1 illustrates a partial area of a plate-shaped fire-resistant element 1, which has two outer layers 2, 3 designed as plates and a center layer 4 lying therebetween and also designed as a plate. The plate-shaped layers 2–4 are thereby joined sandwichlike and are connected with one another by means of a partially applied and nonflammable adhesive 11.

The outer layers 2, 3 are fire-resistant plates out of an organically bound expandable glass granulate, which, moreover, have sound-absorbing characteristics. The center layer 4 is formed by a plaster fiber plate and prevents the penetration of conflagration gases through the fire-resistant element 1. The symmetrical layer construction of the fire-resistant element 1 prevents curvatures of the plates, which may possibly occur at large distances, to be covered with other plates. Such large distances can, for example, have a magnitude of 2400 mm.

It can be recognized that an edge area of the outer layer 2, which lies here on top, is enclosed by a L-shaped edge section 5 and an edge area of the layer 3, which lies here at the bottom, by a U-shaped edge section 6. The edge sections 5, 6 give the fire-resistant element 1 a high mechanical stability and guarantee a protection of the edges of the fire-resistant element 1 against transport and storage damages.

The edge section 5 has a shorter leg 17 and a longer leg 14, whereby the shorter leg 17 covers an outside edge area of the top layer 2 and the longer leg 14 is arranged on an inner area of the outer layer 2, which area faces the center layer 4.

The U-shaped edge section 6 enclosing the edge area of the bottom layer 3 grips around this layer 3 in such a manner that a longer leg 15 is arranged on an area facing the center layer 4, a shorter leg 18 on a lower outer area, and a web 20 connecting the legs 15, 18 on an outside edge area of the plate 3.

The outer plates 2, 3 and the plaster fiber plate 4 lying therebetween are connected by means of screws 7. The plate 3 lying at the bottom has for this purpose a recess 8, into which a screw 9 is guided. The screw 9 clamps by extending through the legs 14, 15 of the edge sections 5, 6 thus holding the outer plates 2, 3 together, whereby the center layer 4 is clamped therebetween. The plates 2–4 are, in this manner, frictionally and positively connected with one another. A screw head 24 is countersunk in the recess 8 and is covered by a fire-resistant mass 10 closing off the recess 8. The screw head 24 is thus, in the case of a fire, protected against a direct flame action.

Figure 2:
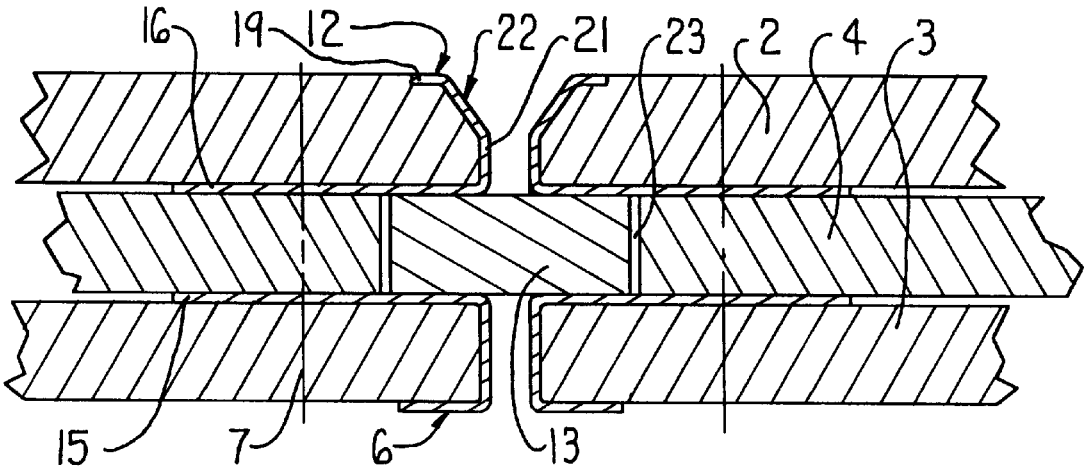
FIG. 2 is a cross-sectional view of a partial area of two further inventive fire-resistant elements.

An exemplary embodiment of two fire-resistant elements, which are arranged side-by-side, is illustrated in FIG. 2, whereby, just like in the other figures, corresponding structural elements have the same reference numerals.

A center plate-shaped layer 4 has smaller outside dimensions in the center than the outer plate-shaped layers 2, 3 and is, forming a recess 23, set back with respect to the outer layers 2, 3. A element 13 is inserted into the corresponding recess 23 of the fire-resistant center layer 4, which lie side-by-side, filling out such recesses. The element 13 does not only create a mechanical support of the fire-resistant layers 2, 3 with respect to one another, but also produces a continuous fire-resistant surface without transition areas to be covered or filled separately.

An edge section 12 enclosing an edge area of the upper outer layer 2 is designed U-shaped, whereby a longer leg 16 is arranged on an area of the layer 2, which area faces the center layer 4. The leg 16 thus forms also a wall of the recess 23 like a leg 15 of an edge section 6 enclosing an edge area of the outer layer 3. A further wall of the recess 23 is formed by an outer edge of the layer 4. A shorter leg 19 of the edge section 12 is countersunk in the plate 2 so that the leg 19 ends flush with the outer surface of the plate 2. Therefore projecting or protruding troublesome structural parts do not exist on the top surface of the layer 2. A web 21 connecting the legs 16, 19 has a sloped area 22 towards the outer surface of the plate 2. The plates 2–4 are connected by means of screws 7 here only schematically illustrated.

Figure 3:
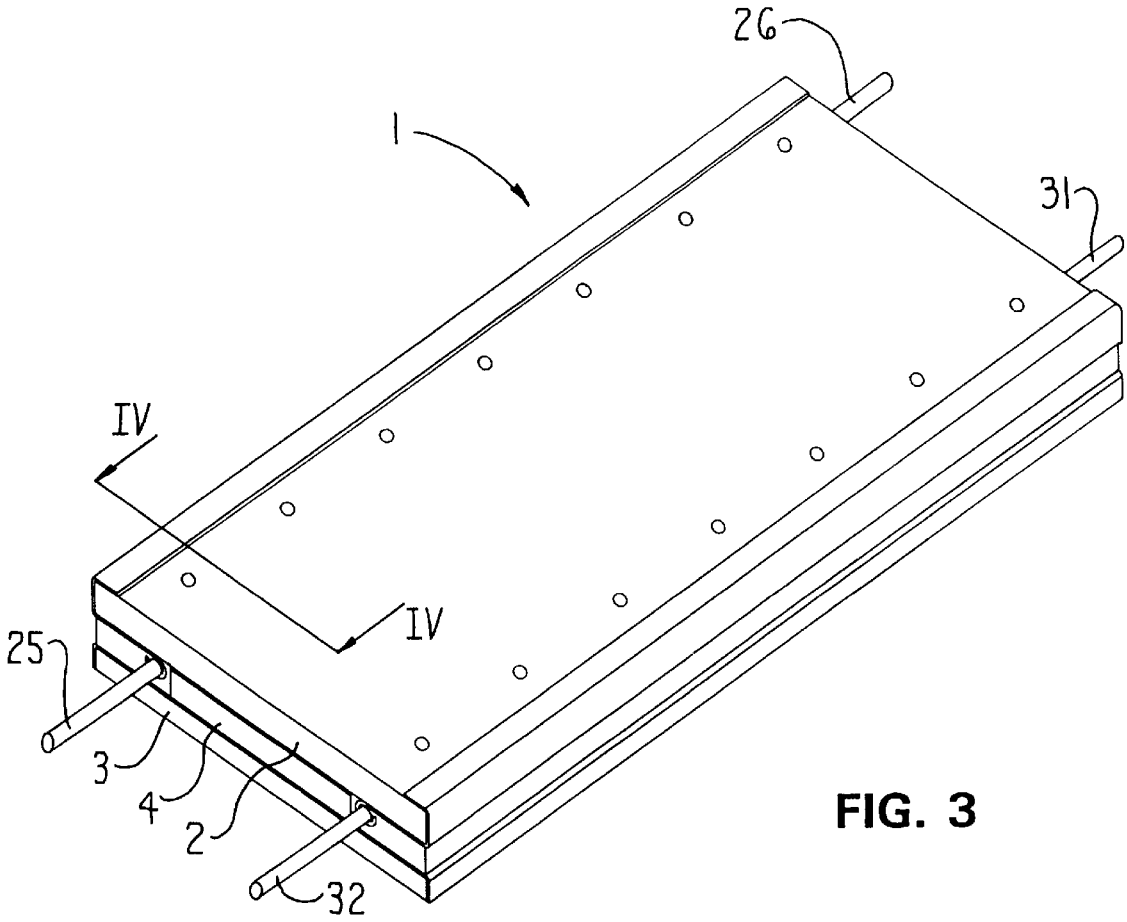
FIG. 3 is a perspective illustration of a further inventive fire-resistant element.

FIG. 3 shows a rectangular fire-resistant element 1, which has two pins 25, 32 and 26, 31 on each of its two cross sides.

Figure 4:
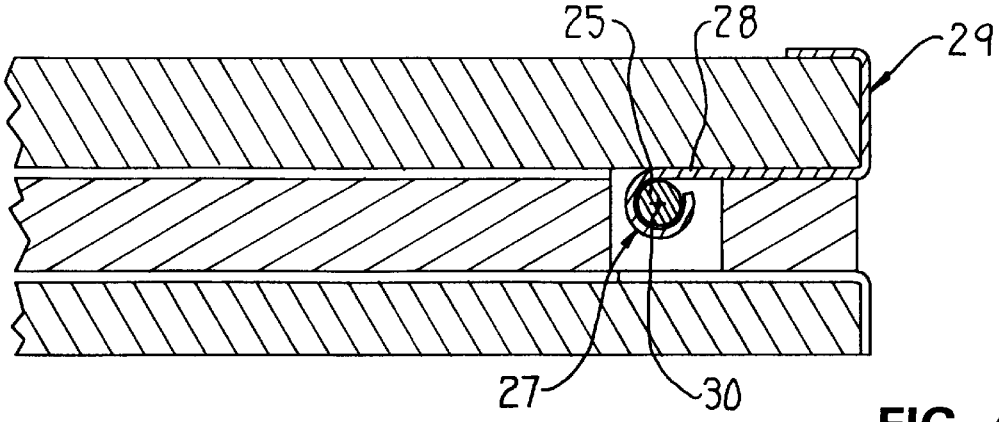
FIG. 4 is a cross-sectional view along the line IV—IV of a partial area of the fire-resistant element of FIG. 3.

The mounting of the pins is shown via the example of the pin 25 in FIG. 4, which illustrates a cross-sectional view along the line IV—IV of FIG. 3. An edge section 29 enclosing a plate-shaped layer 2, which lies here on top, is bent as a circular receiving means 27 in an end area of a leg 28 facing a center layer 4. The pin 25 is inserted into the receiving means 27, the center axis of which pin forms a swivel axis 30. The pin 26, which lies on the opposing side or end of the fire-resistant element 1, is also arranged on this swivel axis 30. It is possible in this manner to suspend the fire-resistant element 1 pivotally in a suitable receiving means, for example on a support for a ceiling of a building. The pins 25, 32, 26, 31 can have a grooving for locking in the receiving means.

The fire-resistant element 1 can be tilted away from the ceiling, for example for servicing cable or supply ducts, whereby said element, however, is still held by the ceiling. The pins of the fire-resistant element can, for this purpose, be supported movably against a spring in their receiving means. To tilt the fire-resistant element 1 away, the element is lifted along one of its longitudinal sides, after which the corresponding pins, which are each arranged on opposing sides or ends are pressed against the spring or the spring element supporting them and finally the element is swung out.

Figure 5:
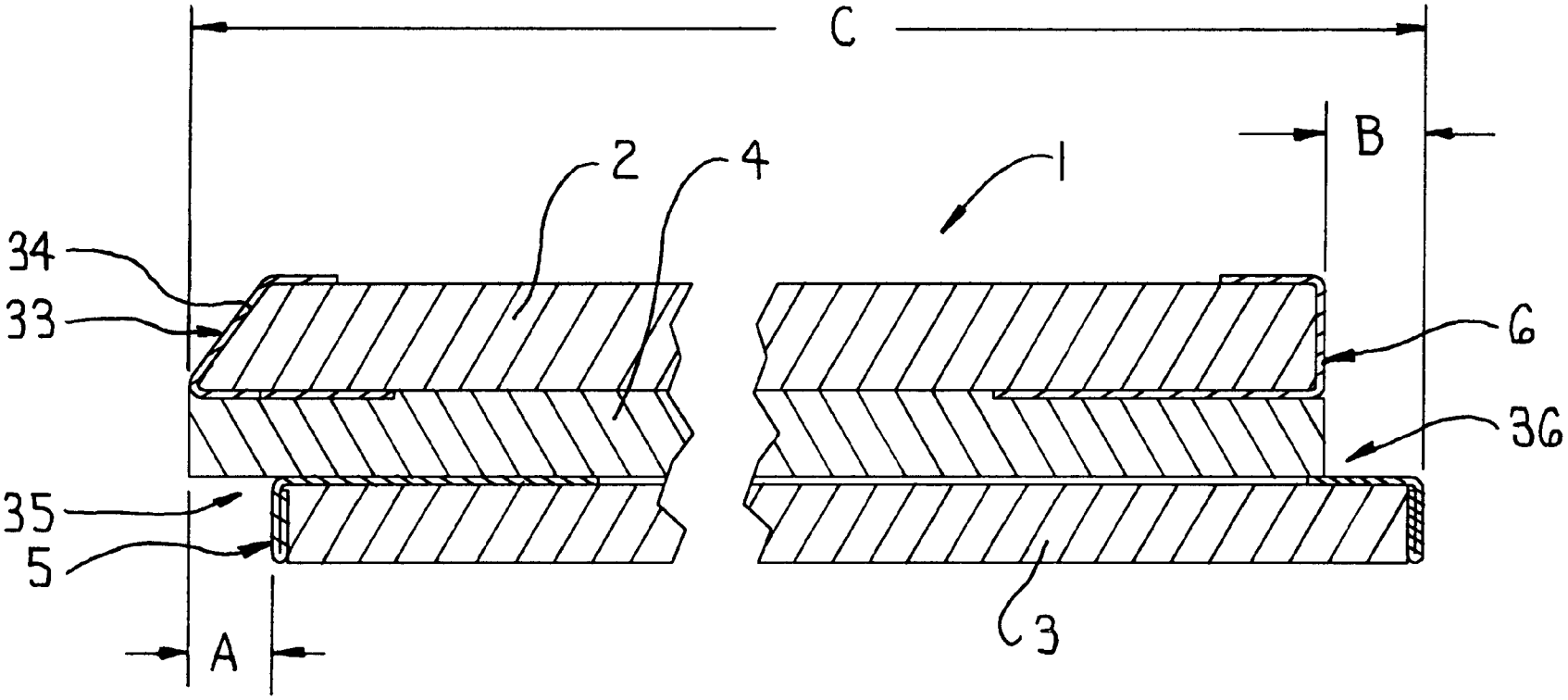
FIG. 5 is a cross-sectional view of a further inventive fire-resistant element.

In the case of the fire-resistant element 1 illustrated in FIG. 5, a plate-shaped outer layer 2, which lies here on top, is together with a plate-shaped center layer 4, which layers 2, 4 have the same outside dimensions, arranged laterally offset at a distance A, forming a first shoulder 35, with respect to a plate-shaped outer layer 3, which lies here at the bottom. The outside dimensions of the outer layer 3, which lies at the bottom, correspond approximately with the outside dimensions of the upper and the center layer 2, 4 so that on the side of the fire-resistant element 1, which side is opposite the first shoulder 35, a second shoulder 36 is formed, which creates a distance B between the outer edges of the upper and the center layer 2, 4 with respect to the bottom layer 3. The distances A, B can have identical dimensions. However, it is advantageous to mount overlapping fire-resistant elements side-by-side in order to compensate for tolerances when the dimension of the one distance is slightly less than the dimension of the other distance. For example, at a total width C of the fire-resistant element 1 of approximately 405 mm, the distance A can be 10 mm and the distance B 8.5 mm.

The outer layer 3, which lies at the bottom, is enclosed by an L-shaped edge section 5 at both longitudinal sides, whereas the outer layer 2, which lies on top, is enclosed by a U-shaped edge section 6 at its longitudinal sides on the one side and opposite thereof by a U-shaped edge section 33. The U-shaped edge section 33 is arranged on the side of the first shoulder 35 and has a web 34, which is bent toward the longitudinal axis of the layer 2 in such a manner that the outer flat surface of the layer 2 is slightly smaller than the inner flat surface of the layer 2, which inner flat surface faces the center layer 4.

The outer layers 2, 3 of the fire-resistant element 1 according to FIG. 5 have an expandable glass granulate or perlite, whereas the center layer 4 is a plaster fiber or calcium silicate plate.

What is claimed is:

1. A plate-shaped fire-resistant element for a ceiling or a wall having a sandwich construction comprising at least three layers which are connected with one another and resist fire from a front and a back side, wherein two outer layers of said at least three layers and a center layer of said at least three layers lying therebetween are constructed as plates, such that an edge area of said two outer layers is enclosed at least on two oppositely lying sides, each with an edge section, and said layers are connected with one another, whereby said two outer layers comprise expandable glass granulate or perlite, and said center layer is constructed to prevent passage of gases.

2. The fire-resistant element according to claim 1, wherein longitudinal sides of said outer layers are enclosed by said edge section.

3. The fire-resistant element according to claim 1, wherein at least two of said layers are connected by an adhesive.

4. The fire-resistant element according to claim 1, wherein at least two of said layers are connected by screws or rivets.

5. The fire-resistant element according to claim 1, wherein said center layer is a plaster fiber plate or a calcium silicate plate.

6. The fire-resistant element according to claim 1, wherein said center layer has smaller outside dimensions than said outer layers, and that on at least one of the outer edges of said fire-resistant element said center layer is set back with respect to said outer layers forming a recess.

7. The fire-resistant element according to claim 6, wherein an element is inserted into the recess.

8. The fire-resistant element according to claim 7, wherein said element is a plaster fiber element or a calcium silicate element.

9. The fire-resistant element according to claim 1, wherein at least one of the edge sections is L-shaped or U-shaped in cross section.

10. The fire-resistant element according to claim 9, wherein legs of the edge section each have a different length.

11. The fire-resistant element according to claim 10, wherein a longer leg of said legs of the edge section is arranged on a center facing area of one of the outer layers facing said center layer.

12. The fire-resistant element according to claim 10, wherein a shorter leg of said legs of the L-shaped edge section covers at least a portion of the edge area of one of said outer layers.

13. The fire-resistant element according to claim 4, wherein the screws or the rivets extend through at least one leg of the edge section, said legs facing the center layer.

14. The fire-resistant element according to claim 4, wherein at least one of the outer layers includes, in the area of the screws or rivets, a recess for receiving the screw or a rivet head.

15. The fire-resistant element according to claim 14, wherein the recess is closed off with a fire-resistant mass.

16. The fire-resistant element according to claim 1, wherein the fire-resistant element includes a pin on the two oppositely lying sides, whereby the pins form a common swivel axis.

17. The fire-resistant element according to claim 16, wherein the pins are arranged in an area of a leg of one of the edge sections, which area is constructed as a receiving means.

* * * * *